US006142194A

United States Patent [19]

McClaran

[11] Patent Number: 6,142,194

[45] Date of Patent: Nov. 7, 2000

[54] PRESSURE FUEL SERVICING NOZZLE

[75] Inventor: Mark Randall McClaran, Orange, Calif.

[73] Assignee: Cla-Val, Costa Mesta, Calif.

[21] Appl. No.: 09/265,018

[22] Filed: Mar. 9, 1999

[51] Int. Cl.[7] ..... B67C 3/34

[52] U.S. Cl. ..... 141/346; 141/384; 141/386; 137/614.06

[58] Field of Search ..... 141/346, 382, 141/383, 384, 386, 1, 387–389; 137/614.06

[56] References Cited

U.S. PATENT DOCUMENTS

| | | | |
|---|---|---|---|
| 2,665,925 | 1/1954 | Frasaer | 141/384 |
| 2,729,471 | 1/1956 | Fraser | 141/384 |
| 3,034,544 | 5/1962 | Griswole | 141/346 |
| 3,055,405 | 9/1962 | Pase | 141/384 |
| 3,123,099 | 3/1964 | Breuning et al. . | |
| 3,217,747 | 11/1965 | Joanis et al. | 137/614.06 |
| 3,301,272 | 1/1967 | Pettyjohn et al. | 137/614.06 |
| 4,103,712 | 8/1978 | Fletcher et al. . | |
| 4,192,347 | 3/1980 | Richard . | |
| 4,359,066 | 11/1982 | Hunt | 137/614.06 |
| 4,469,122 | 9/1984 | Meek | 251/143 |
| 4,567,924 | 2/1986 | Brown | 141/346 |
| 5,127,428 | 7/1992 | Fahl . | |
| 5,293,913 | 3/1994 | Preszler | 141/346 |
| 5,295,507 | 3/1994 | Bandy et al. | 137/614.06 |
| 5,404,909 | 4/1995 | Hanson | 137/614.06 |
| 5,407,175 | 4/1995 | Roberts et al. | 251/148 |
| 5,435,413 | 7/1995 | Schoenborn | 141/386 |
| 5,520,418 | 5/1996 | Burke . | |
| 5,540,413 | 7/1996 | Brown | 251/143 |
| 5,765,610 | 6/1998 | Brown | 141/383 |
| 5,788,290 | 8/1998 | Meisinger . | |
| 5,947,171 | 9/1999 | Woodruff | 141/346 |

FOREIGN PATENT DOCUMENTS

| | | |
|---|---|---|
| 0117702 A2 | 9/1984 | European Pat. Off. . |
| 1 029 841 | 5/1966 | United Kingdom . |

*Primary Examiner*—J. Casimer Jacyna

*Attorney, Agent, or Firm*—Oppenheimer Wolff & Donnelly LLP

[57] ABSTRACT

The invention relates to a pressure fuel servicing nozzle for mating with a standardized aircraft fueling adapter having a cylindrical extension with a plurality of indexing notches and a plurality of radially extending lock tabs. The fuel nozzle includes a nozzle body having an outer surface and an interior passage. A collar assembly is rotatably supported upon the outer surface of the nozzle body. A plurality of locating pins having a rectangular cross-section extend outwardly from the bottom base of the nozzle body. The fuel nozzle is properly aligned onto the fueling adapter by fitting the locating pins in the indexing notches of the fueling adapter such that the two opposing side faces contact the surfaces of the indexing notches. The fuel servicing nozzle further includes an interlock plate biased toward an exterior of the nozzle body by a plurality of spaced springs. The interlock plate has a plurality of apertures through which the locating pins pass. When the fuel nozzle is in a disconnected condition with the fueling adapter, the interlock plate forms a mechanical interference between the plurality of locating pins and the inner surfaces of a bayonet ring such that the collar assembly is locked about the nozzle body. When the fuel nozzle is connected to the fueling adapter, the interlock plate is depressed and the mechanical interference is cleared such that the collar assembly is free to rotate about the nozzle body.

45 Claims, 6 Drawing Sheets

FIG. 1
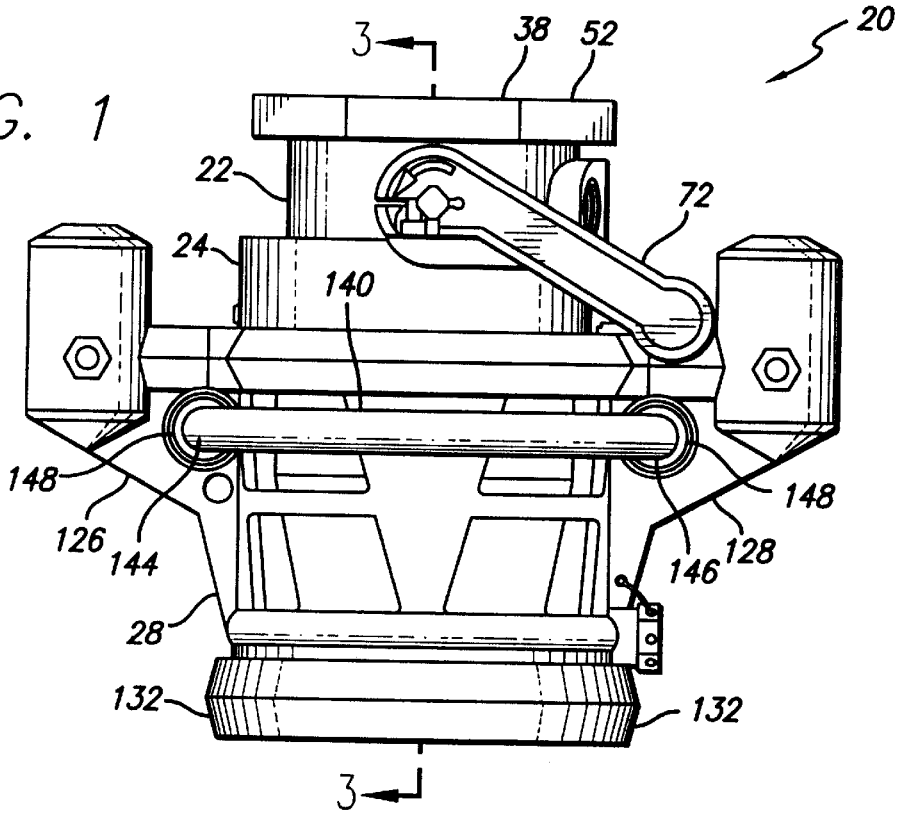
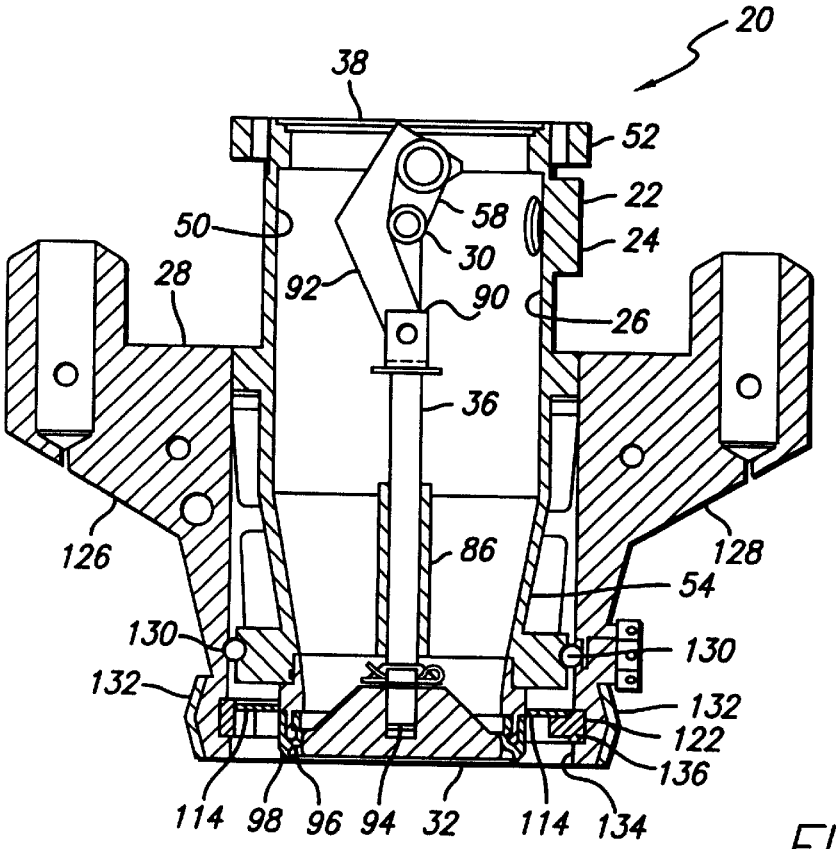
FIG. 6

FIG. 2
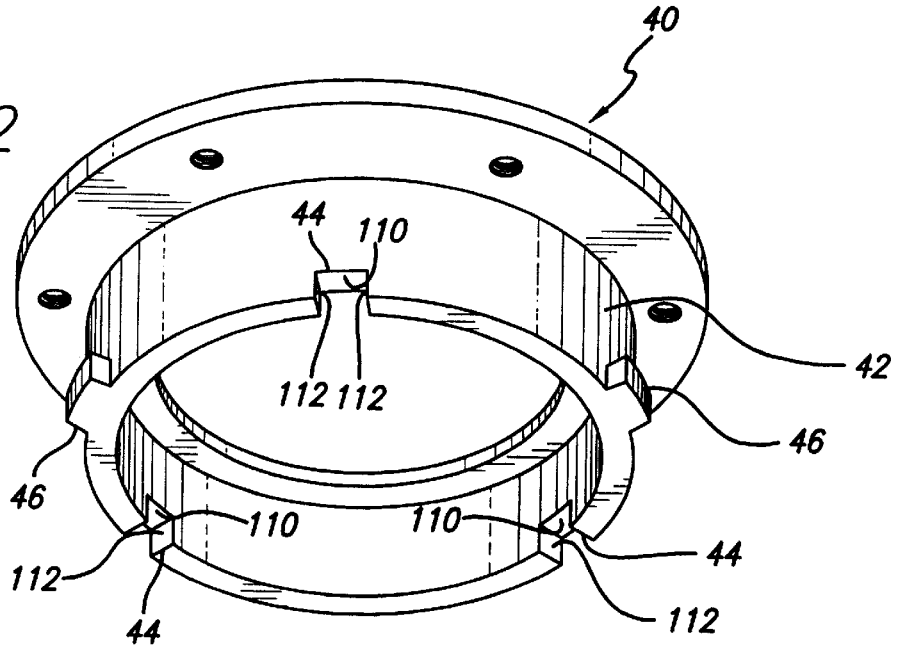
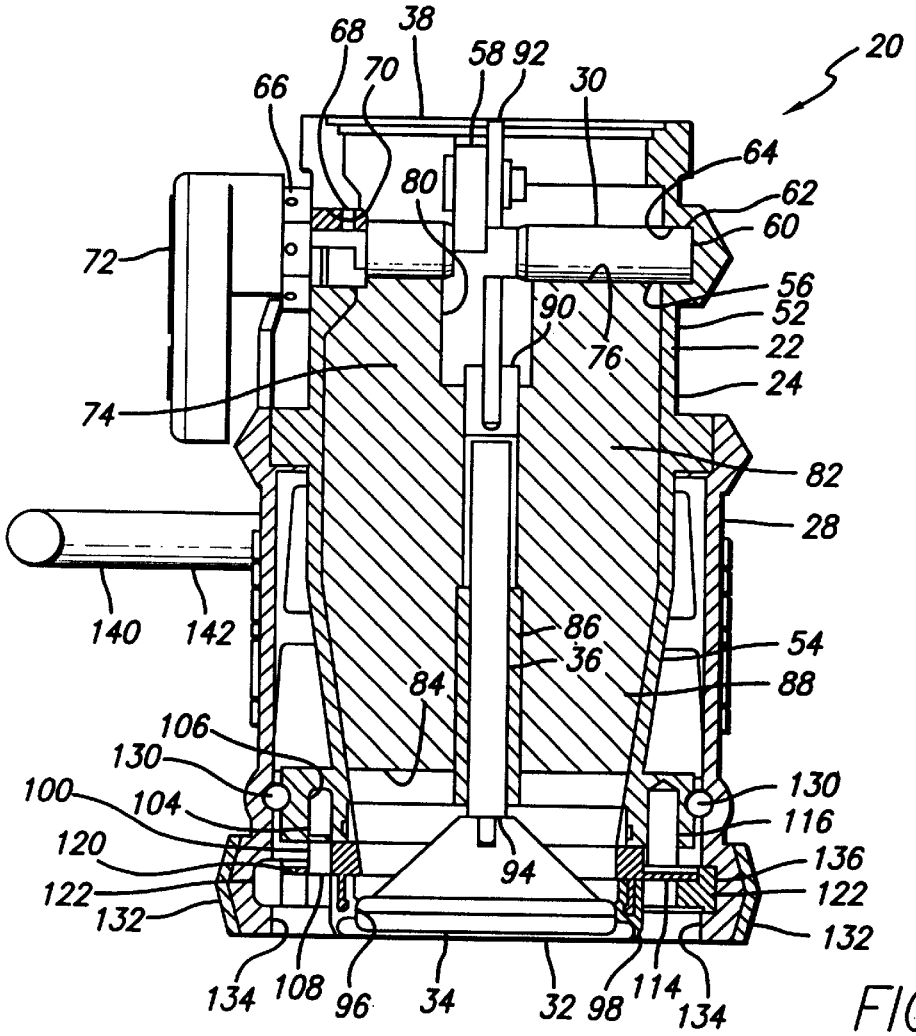
FIG. 3

FIG. 4
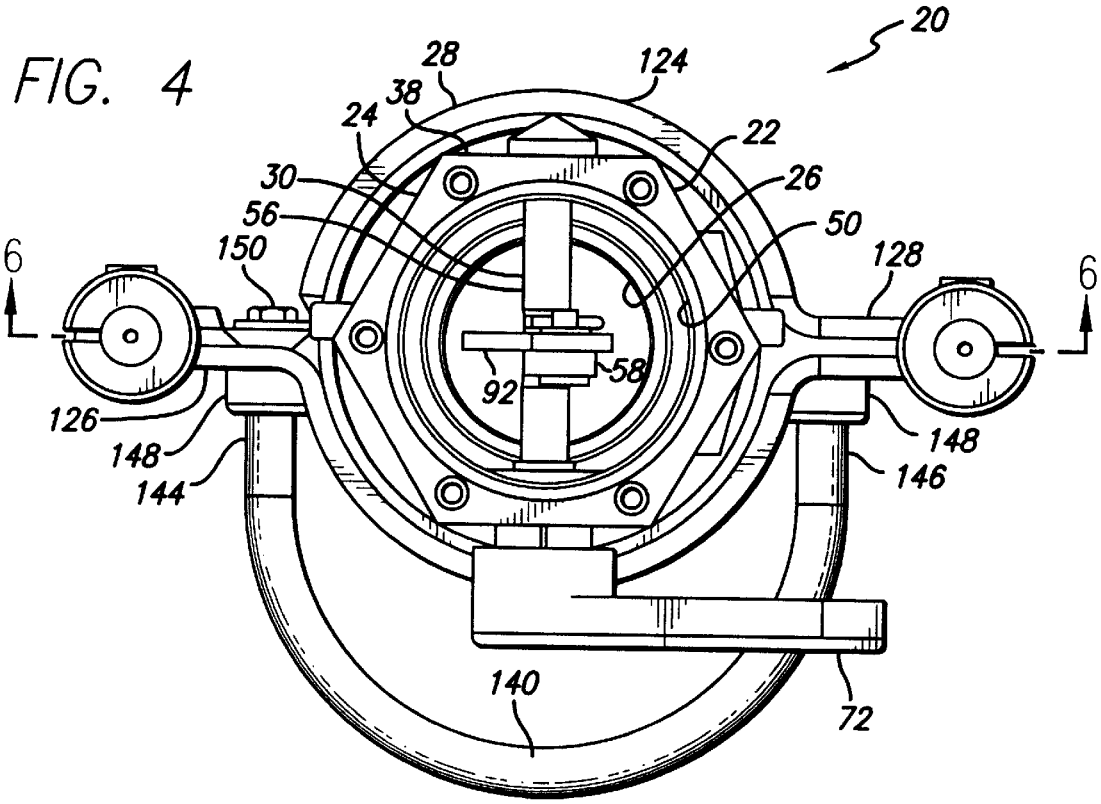
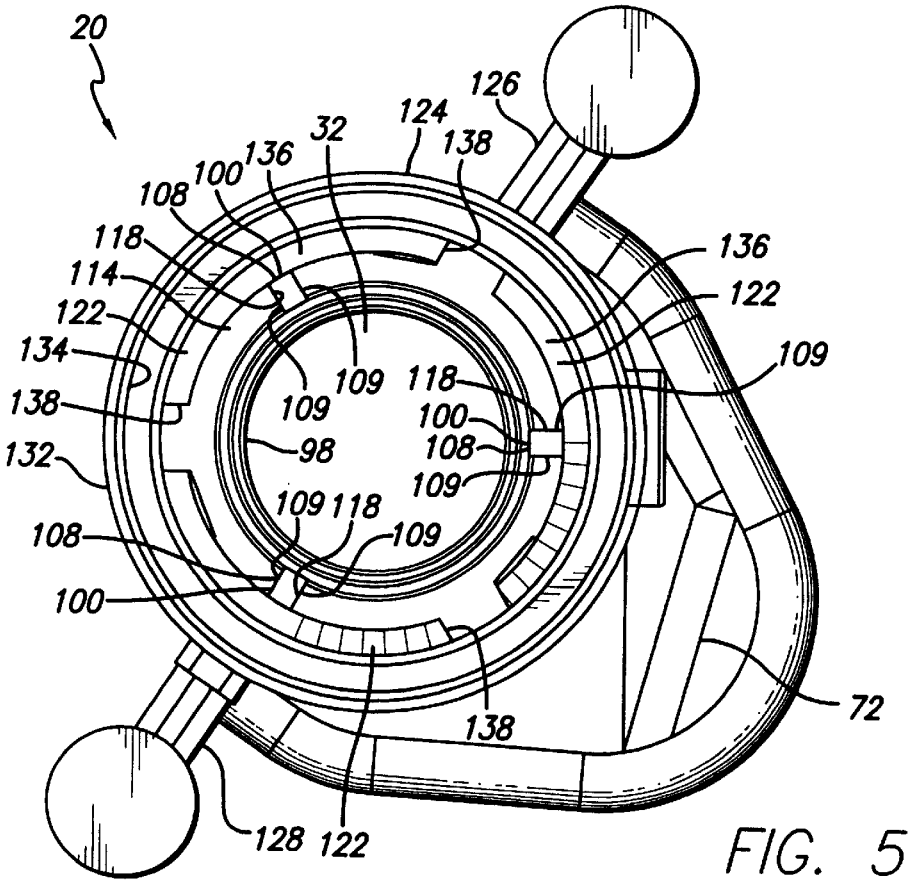
FIG. 5

PRESSURE FUEL SERVICING NOZZLE

FIELD OF THE INVENTION

The invention relates generally to pressure fuel servicing nozzles for mating with a standardized aircraft fueling adapter having a cylindrical extension with a plurality of indexing notches and a plurality of radially extending lock tabs.

BACKGROUND OF THE INVENTION

An aircraft fuel system includes a fuel line which terminates in an exposed fueling adapter at the fuel input point. Refueling facilities include a stationary or mobile fuel supply having an extended large diameter hose or articulated pipe and various pumps for delivery of the fuel under pressure. A pressure fuel servicing nozzle is secured to the delivery end of the fuel hose or pipe and is mechanically configured to engage and receive the fueling adapter. The fuel servicing nozzle is required to perform several basic mechanical functions which include mechanically engaging and locking with the fueling adapter, providing a high pressure fuel seal between the fuel delivery hose and the aircraft fuel system, and properly valving the fuel flow between the fuel system and the aircraft to provide open flow and closed seal conditions to facilitate fueling and the termination of fueling. In addition to these basic functions, modem fuel servicing nozzles provide various safety mechanisms directed toward the prevention of fuel spillage and leakage. This is critical to the operation of such refueling systems due to the highly volatile and flammable character of aircraft fuels. One such safety mechanism provides an interlock within the fuel service nozzle which prevents opening a flow control poppet valve until the nozzle has completed proper mechanical and sealing engagement with the fueling adapter.

Generally, existing fuel servicing nozzles comprise a rotating sleeve rotatably mounted upon a nozzle body which receives and locks to the aircraft fueling adapter to provide engagement. An interlock prevents the opening of the flow control poppet valve within the nozzle body until mechanical engagement as evidenced by the rotational position of the sleeve is obtained. A receiving portion within the nozzle body receives and engages the aircraft fueling adapter and includes a plurality of spring supported depressible lock pins. The lock pins prevent the rotation of sleeve in the absence of the insertion of the aircraft fueling adapter.

To connect the fuel nozzle to the fueling adapter, an operator aligns three cylindrical-shaped locating pins with three square indexing slots of the fueling adapter. When the fuel nozzle is aligned, the fuel nozzle can be pushed into the fueling adapter, thereby depressing the interlock pins which, in turn, allows the sleeve to be rotated about the nozzle body. The flow control poppet valve is now free to be opened. Of particular note is that current fuel nozzles utilize cylindrical-shaped locating pins which wear the flat surface of the indexing notches into oval-shaped notches. This effects the safety of the connection between the fuel nozzle and the fueling adapter because the nozzle body may no longer be held in the correct position when the sleeve is being rotated about the nozzle body during both connection and disconnection. Under these conditions, the fuel nozzle might be removed from a worn fueling adapter with the interlock feature defeated, allowing the flow control valve poppet to be opened when not properly connected to the fueling adapter, resulting in a dangerous spill of fuel.

Another problem which arises in existing fuel servicing nozzles is the premature wear of the mechanism which closes and opens the flow control poppet valve. Most existing fuel servicing nozzles utilize a crank shaft mechanism to open and close the flow control poppet valve. The crank shaft is positioned perpendicularly to the longitudinal axis of the nozzle body and is connected to a valve operating handle. The crank shaft includes an off-set crank arm which is connected to the poppet valve by a valve stem. As the valve operating handle is rotated to the open position, the crank shaft rotates and the crank arm is rotated and pushes the valve stem and poppet valve downward to the open position. The poppet valve is closed by rotating the operating handle back to the original position. When the fuel is pressurized by a fuel pump, large loads are imposed on the poppet valve when it is in the closed position. The load on the poppet valve is primarily supported by the crank shaft, which retains the poppet valve in the closed position. In existing fuel servicing nozzles, the crank shaft is often insufficiently supported by the nozzle body, resulting in premature wear or in extreme circumstances, fatigue failure of the crank shaft or the support structure thereof. Such premature wear or fatigue failure may lead to a leaky fuel nozzle or complete failure of the fuel nozzle to retain the fuel.

Additional problems arise due to the operating environment in which the typical fuel nozzle is utilized. The environment involves handling long relatively heavy fueling hoses under a variety of situational urgencies as well as all weather conditions. As a result, such aircraft fueling nozzles are often subjected to excessive mechanical forces. For example, the fuel servicing nozzle is often dropped or dragged on the ground, resulting in wear and damage of various unprotected components such as the valve operating handle. In addition, the portion of the nozzle body which engages with the aircraft fueling adapter may wear due to repeated connection/disconnection with the fueling adapter. Materials having high wear resistance may be used to form the nozzle body, but utilizing these high wearing materials may increase the weight of the fuel servicing nozzle to the point where it is difficult to handle.

Thus, there remains a need for an improved aircraft fuel servicing nozzle designed to connect and disconnect to a standardized fueling adapter mounted on an airframe and connected to an internal fuel manifold and tank system. In particular, a reliable and rugged fuel servicing nozzle is desireable which is light weight and easy to operate .

BRIEF SUMMARY OF THE INVENTION

In accordance with the present invention, an improved aircraft fuel servicing nozzle is provided which is designed to connect and disconnect with a standardized fueling adapter mounted on an airframe and connected to an internal fuel manifold and tank system. The present invention achieves the objective connecting and disconnecting with a fueling adapter in a reliable and rugged manner and yet being relatively light weight and easy to operate. The fuel servicing nozzle of the present invention is particularly directed to engaging and disengaging with a standardized fueling adapter. The fueling adapter comprises a cylindrical extension with a plurality of indexing notches and a plurality of radially extending lock tabs.

The fuel servicing nozzle comprises a nozzle body having an outer surface an interior passage. A collar assembly is rotatably supported upon the outer surface of the nozzle body. A valve operating handle is rotatively coupled to the nozzle body. A guard bar projects outwardly from the collar assembly to protect the operating handle when the fuel nozzle is dropped or dragged on the ground during the refueling process. A plurality of locating pins extend outwardly from the bottom base of the nozzle body. The fuel nozzle is properly aligned onto the fueling adapter by fitting the locating pins into the indexing notches of the fueling adapter. In the preferred embodiment, the locating pins have a square-shaped cross section such that the top face and two opposing side faces contact the surfaces the of the indexing notches. The locating pins may be threaded into bores formed on the base of the nozzle body.

The fuel servicing nozzle further includes an interlock plate biased toward and an exterior of the nozzle body by a plurality of spaced springs. The interlock plate has a plurality of apertures through which the locating pins pass. When the fuel servicing nozzle is in a disconnected condition with the fueling adapter, the interlock plate forms a mechanical interference between the plurality of locating pins and the inner surfaces of a bayonet ring such that the collar assembly is locked about the nozzle body. When the fuel nozzle is connected to the fueling adapter, the interlock plate is depressed inward toward the nozzle body and the mechanical interference with the bayonet ring is cleared such that the collar assembly is free to rotate about the nozzle body. The apertures in the interlock plate are square-shaped and have sides located in close proximity to the sides of the square-shaped locating pins to prevent rotation of the locating pins.

The bayonet ring extends inwardly from the interior surface of the collar assembly and comprises a ring separated by three gaps. These gaps accept the lock tabs of the fueling adapter. To increase service life of the fuel service nozzle, the bayonet ring is formed from a strong, wear resistant metal such as stainless steel, while the collar assembly is made from a relatively lightweight metal such as aluminum. In the embodiment shown in the figures, the bayonet ring is embedded in the collar assembly during the casting of the collar assembly. To further lighten the fuel nozzle, the main body of the collar assembly is reticulated.

A crank shaft extends transversely across the nozzle body. The crank shaft comprises a main shaft and a crank arm which is disposed near the midlength of the main shaft and extends radially outwardly from the main shaft. A first end of the main shaft is supported by a bearing mounted in a recess in the side wall of the nozzle body, while a second end of the main shaft extends through a bearing sleeve disposed in an opening in the opposite side wall of the nozzle body. The second end of the shaft is connected to the operating handle. In addition to being supported at both ends by bearings, the crank shaft is further supported by a cradle. The cradle extends from one side wall to the opposite side wall of the nozzle body. The top surface of the cradle is concave-shaped to conform to the diameter of the crank shaft. Preferably, a gap about three to five thousands of an inch exists between the concave surface of the cradle and the outer surface of the crank shaft. The crank shaft may be pulled under a load into contact with the concave surface, thus being fully supported by the cradle and prevented from bending. A rectangular slot is located near the center portion of the cradle to allow clearance for the rotation of the crank arm. The cradle is formed on top of a web which is a generally flat wall extending radially outwardly with sides contacting the side wall of the nozzle body. The web splits the flow path of the fuel into two equally sized and shaped passageways. A cylindrical-shaped sleeve is formed in the lower portion of the web. The cradle, web, and sleeve are integrally formed with the nozzle body and are positioned underneath the crank shaft to promote maximum fuel flow capabilities.

Other objects, features, and advantages of the present invention will become apparent from a consideration of the following detailed description.

BRIEF DESCRIPTION OF THE SEVERAL VIEWS OF THE DRAWINGS

FIG. 1 is a plan side view of a fuel servicing nozzle in accordance with the present invention;

FIG. 2 is a perspective view of a standardized fuel tank adapter which mates with the fuel servicing nozzle of FIG. 1;

FIG. 3 is a cross-sectional view taken through the fuel service nozzle along line 3—3 of FIG. 1;

FIG. 4 is a plan top view of the fuel service nozzle shown in FIG. 1;

FIG. 5 is a plan bottom view of the fuel service nozzle shown in FIG. 1 illustrating square locating pins;

FIG. 6 is a cross-sectional view taken through the fuel service nozzle along line 6—6 of FIG. 4;

DETAILED DESCRIPTION OF THE PREFERRED EMBODIMENTS

Figure 7:
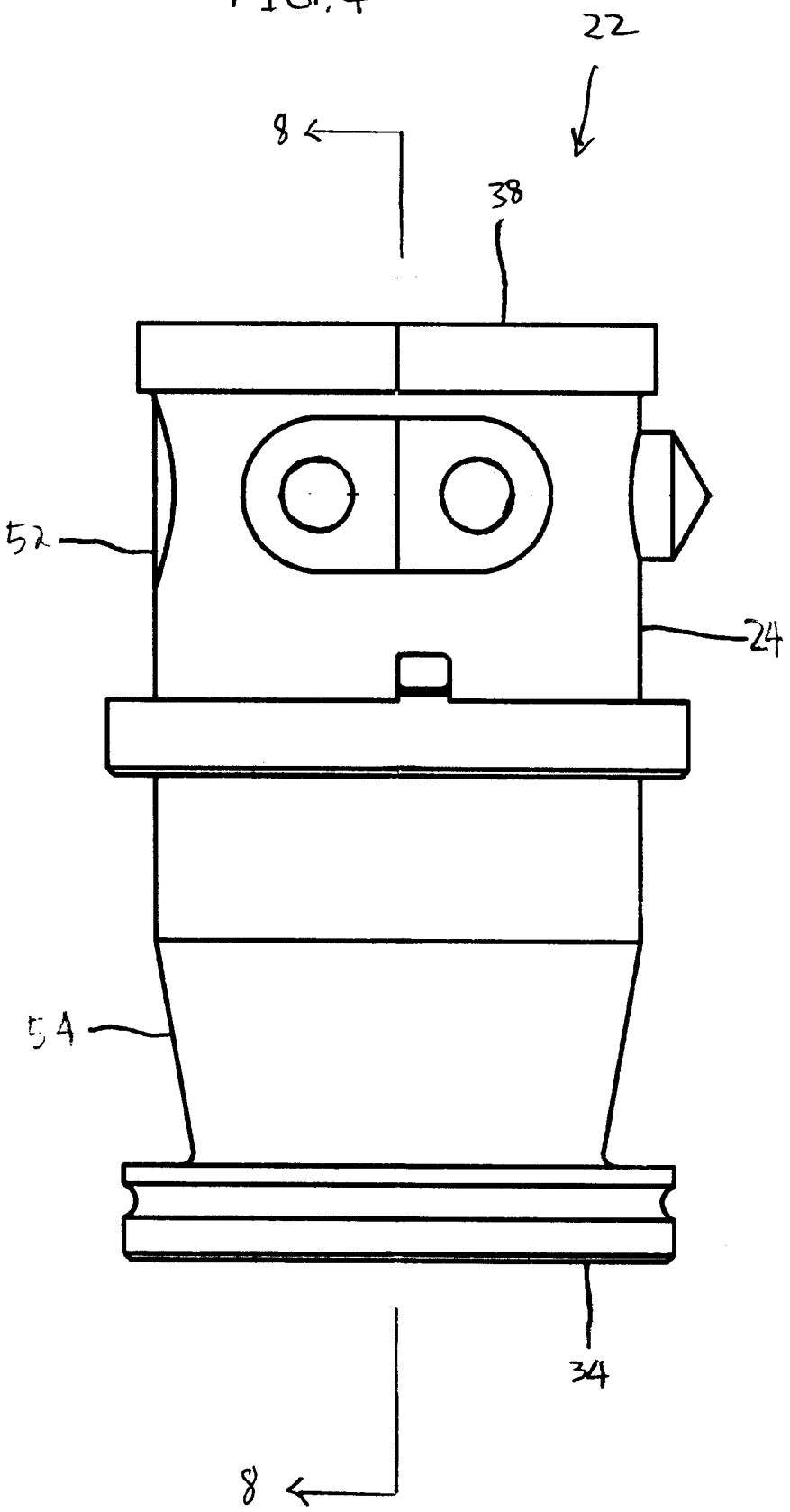
FIG. 7 is a plan side view of the nozzle body.

Referring to FIGS. 1, 3, 6 , an aircraft pressure fuel servicing nozzle 20 of the present invention is illustrated. The fuel nozzle 20 includes a nozzle body 22 having an outer surface 24 and an interior passage 26 extending therethrough as illustrated in FIG. 7. A collar assembly 28 is rotatably supported upon the outer surface 24 of the nozzle body 22, and a crank shaft 30 extends across the entire inner diameter of the interior passage 26. A poppet valve 32 seals a bottom end of the nozzle body 22, and a valve stem 36 connects the crank shaft 30 to the poppet valve 32.

The top end 38 of the nozzle body 22 is connected to a fuel delivery coupling such as a fuel delivery hose (not shown) or the like and the bottom end 34 mates with a standardized aircraft fueling adapter 40 as illustrated in FIG. 2. The fueling adapter 40 has a cylindrical extension 42 with a plurality of indexing notches 44 and a plurality of radially extending lock tabs 46. To provide high fuel flow rates, an interior side wall 50 of the nozzle body 22 is smoothly contoured and includes an upper portion 52 which is generally cylindrical-shaped and a bottom portion 54 which is generally cone shaped. In addition, the interior wall 50 is smoothly finished to promote fuel flow. In the embodiment illustrated in the figures, the nozzle body 22 is integrally formed from an investment casting and is made from a lightweight and strong metal such as aluminum.

Referring to FIGS. 3 and 4, the crank shaft 30 extends transversely across the nozzle body 22 and is above the valve stem 36. The crank shaft 30 comprises a main shaft 56 and a crank arm 58 which is disposed near the midlength of the main shaft 56 and extends radially outwardly from the main shaft 56. A first end 60 of the main shaft 56 is supported by a bearing 62 formed in a recess 64 in the side wall of the nozzle body 22. A second end 66 of the main shaft 56 extends through a bearing sleeve 68 disposed in an opening 70 in the opposite side wall of the nozzle body 22.

The second end 66 of the main shaft 56 is connected to a valve operating handle 72 which provides a means of rotating the crank shaft 30.

Figure 8:
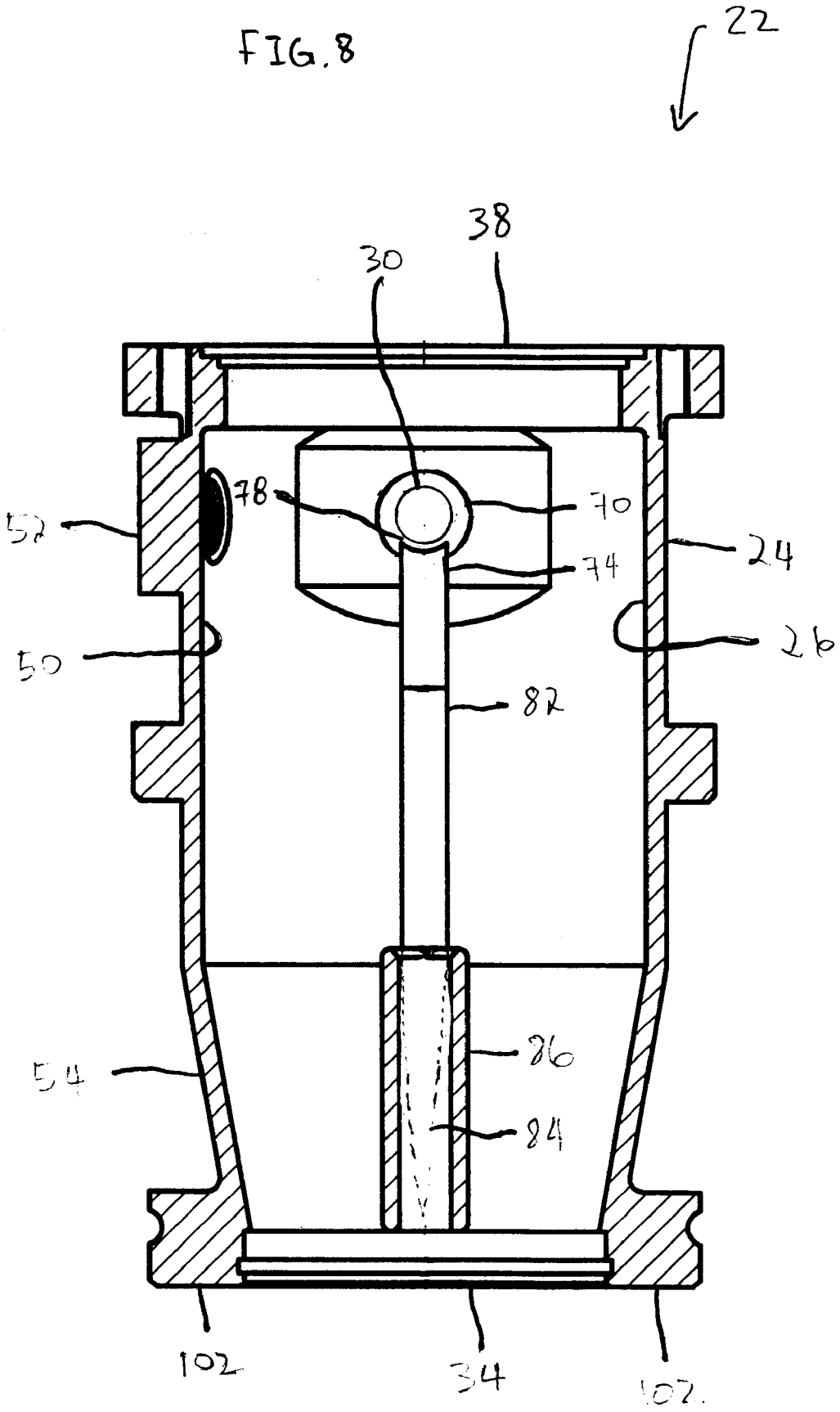
FIG. 8 is a cross-sectional view taken through the nozzle body along line 8—8 of FIG. 7.

In addition to being supported at both ends by the bearings 62, 68, the crank shaft 30 is further supported by a cradle 74 as illustrated in FIG. 8. The cradle 74 extends from one side wall 50 to the opposite side wall 50 of the nozzle body 22 and may have a thickness equal to or less than the diameter of the crank shaft 30. The top surface 76 of the cradle 74 is concave-shaped to conform to the diameter of the crank shaft 30. Preferably, a gap 78 about three to five thousands of an inch exists between the top surface 76 and the outer surface of the crank shaft 30. When the crank shaft 30 is under a load such as when the fuel is pressurized and the poppet valve 32 is closed, the crank shaft 30 may come into contact with the top surface 76, thus being fully supported by the cradle 74 and resistant to bending. Referring to FIG. 3, a rectangular slot 80 is located near the center portion of the cradle 74 to allow clearance for the rotation of the crank arm 58. The cradle 74 is formed on top of a web 82 which is generally a flat wall extending radially outwardly with sides contacting the side wall 50 of the nozzle body 22. In the embodiment illustrated in the drawings, the web 82 is about 0.4 inch thick near the cradle 74 and tapers to a reduced thickness near the bottom end 84 to promote a smooth flow path for the fuel. A cylindrically shaped sleeve 86 is formed in the lower portion 88 of the web 82. The outer diameter of the sleeve 86 is about 0.6 inch and the inner diameter is about 0.4 inch. By providing the combined features of the full length crank shaft 30 which extends across the entire inner diameter of the interior passage 26, the cradle 74, and the web 82, the fuel nozzle 20 is highly reliable and robust. It is also noted that the cradle 74, web 82 and sleeve 86 are integrally formed with the nozzle body 22.

Figure 9:
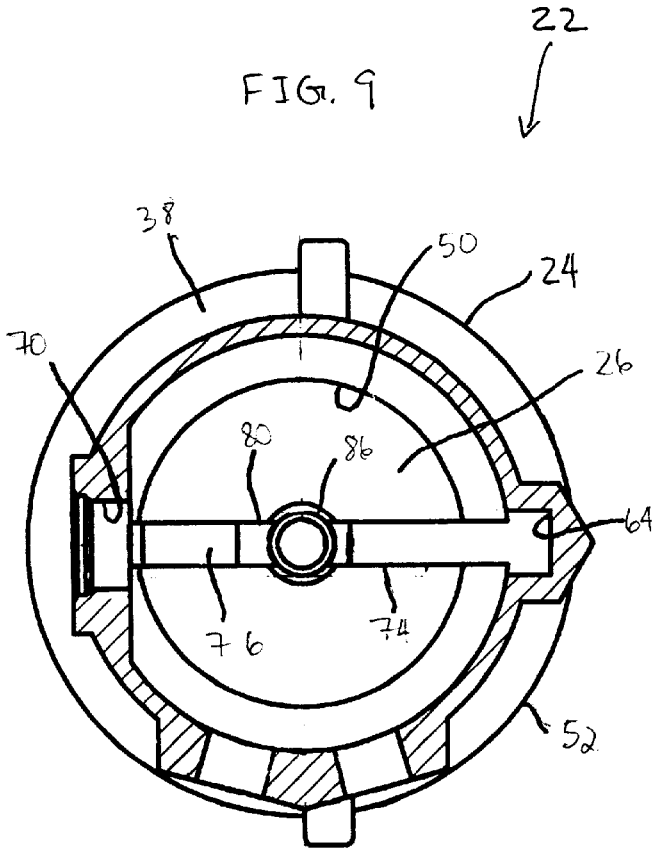
FIG. 9 is a plan top view of the nozzle body shown in FIG. 7.
Figure 10:
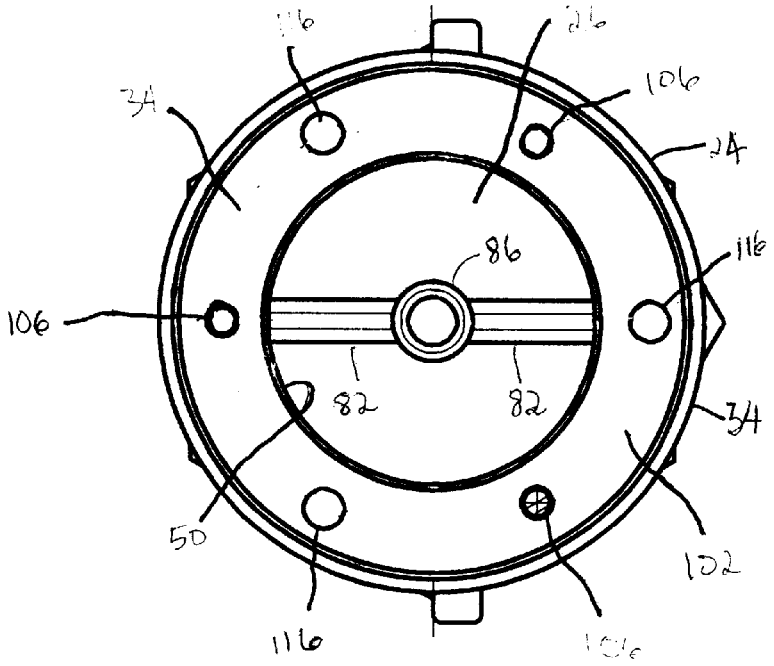
FIG. 10 is a plan bottom view of the nozzle body shown in FIG. 7.
Figure 7:
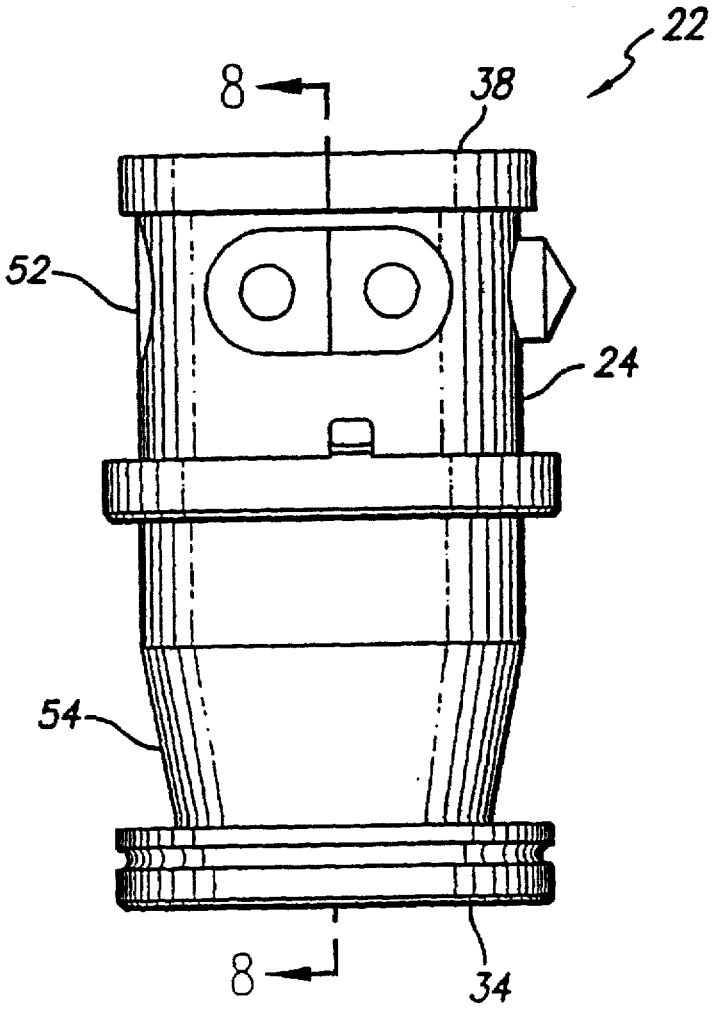
Figure 8:
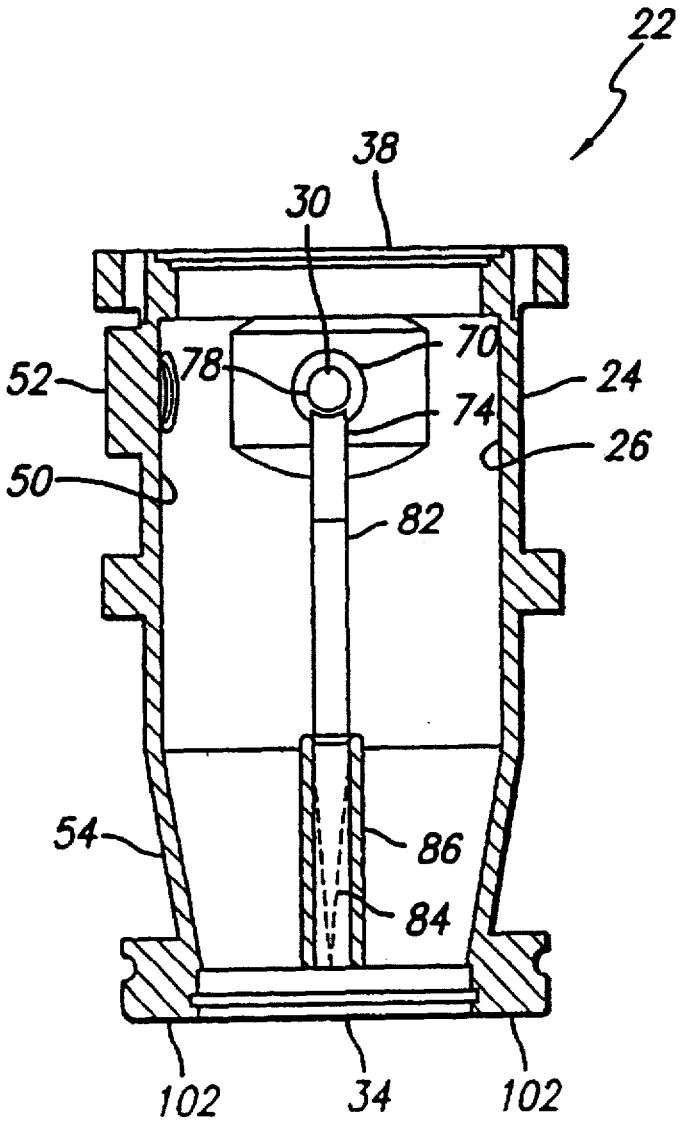

Referring to FIG. 3, the valve stem 36 is slidingly guided by the sleeve 86, and the top end 90 of the valve stem 36 is connected to the crank arm 58 by a V-shaped arm 92 while the bottom end 94 of the valve stem 36 is directly connected to the poppet valve 32. The poppet valve 32 is movable along the longitudinal axis of the nozzle body 22, and the poppet valve 32 is configured to engage and form a sealing contact with an interior surface 96 of a nose seal 98 formed from a polyester polyurethane. The position of the poppet valve 32 with respect to the nose seal 98 determines the poppet valve 32 open and closed positions for the fuel nozzle 20. This position is determined by the rotational position of the valve operating handle 72 and crank shaft 30. The poppet valve 32 is screwed onto the bottom end 94 of the valve stem 36 by threads such that the position of the poppet valve 32 relative to the interior surface 96 of the nose seal 98 may be finely adjusted for proper sealing. As can be seen in FIGS. 9 and 10, the cradle 74, web 82, sleeve 86 and valve stem 36 are positioned underneath the crank shaft 30 to maximize the cross-sectional flow path of the fuel, and thus, promoting maximum fuel flow capabilities.

Referring to FIGS. 5 and 10, three locating pins 100 extend outwardly from the base 102 of the nozzle body 22. The locating pins 100 have a cylindrical portion 104 which is threaded into round holes 106 provided in the base 102 of the nozzle body 22 and a square-shaped cross-sectional portion 108 which extends outwardly. Of particular note is that existing fuel nozzles on the market today have round pins which tend to wear the top flat surface 110 and opposing side flat surfaces 112 of the square-shaped indexing notches 44 of the fueling adapter 40 into a more oval shape slot. One of the disadvantages of forming an oval shape indexing slot is that the fuel nozzle may no longer be held in the correct position when the collar assembly is being rotated relative to the nozzle body during both connection and disconnection with the fueling adapter 40. In the worst condition, the fuel nozzle may be removed from a worn fueling adapter 40 with the interlock feature defeated which would subsequently allow the fuel nozzle to be opened when not connected to the fueling adapter. This may result in a dangerous spill of jet fuel.

The square-shaped locating pins 100 overcome this problem by having the flat sides 109 closely and accurately interfacing with the respective side flat faces 112 of the indexing notches 44, even when there is little left of the side flat faces 112 and top flat surface 110 of a worn fueling adapter. It should be noted that the locating pins may have other cross-sectional shapes other than a square such as a rectangular-shaped locating pin as long as the top flat face and the two opposing side faces are flat and sufficiently large to contact the entire flat surfaces 110, 112 of the indexing notches 44 of the fueling adapter 40.

The base 102 of the nozzle body 22 receives a spring loaded interlock plate 114. The interlock plate 114 is biased toward the exterior of the nozzle body 22 toward the aircraft connection end by three equally spaced springs 116. The three locating pins I 00 are equally positioned around the nose seal 98 and protrude through slots 118 in the interlock plate 1 14. In the static, disconnected condition, the interlock plate 114 forms a mechanical interference between the three locating pins 100 and lugs 120 specifically formed on the inner surfaces of a bayonet ring 122 such that the collar assembly 28 can not be rotated about the nozzle body 22.

Referring to FIG. 1, the collar assembly 28 includes a main portion 124 having a generally cylindrical shape which is larger in diameter than the exterior of the nozzle body 22 and surrounds the nozzle body 22, a first flange portion 126 extending radially outwardly from the main portion 124, and a second flange portion 128 extending radially outwardly from the main portion 124 and offset about 180 degrees from the first flange portion 126. Each flange portion 126, 128 accepts an upwardly extending handle (not shown) used by the operator to manipulate the fuel nozzle 20. The collar assembly 28 is rotatably supported upon the underlying outer surface 24 of the nozzle body 22 and is maintained in its position by a plurality of ball bearings 130 such that the collar assembly 28 may be rotated with respect to the nozzle body 22. The collar assembly 28 further supports a resilient bumper 132 which encircles the bottom portion of the outer surface of the collar assembly 28. The bayonet ring 122 extends inwardly from the interior surface 134 of the collar assembly 28 and comprises a ring 136 separated by three gaps 138, and these gaps 138 accept the lock tabs 46 of the fueling adapter 40. In order to increase the service life of the fuel nozzle 20, the bayonet ring 122 is formed from a relatively strong material such as stainless steel to withstand the repeated connection/disconnection with the fueling adapter 40. In the embodiment shown in the drawings, the bayonet ring 122 is embedded in the collar assembly 28 during the casting of the collar assembly 28. When using the lost wax casting method, the bayonet ring is embedded in a wax pattern of the collar assembly. The wax pattern and bayonet ring are then invested and molten aluminum is poured into a mold containing the bayonet ring 122. Thus, the collar assembly 28 is relatively light because it is formed predominantly from aluminum while the bayonet ring is sufficiently hard for superior wear resistance.

Referring to FIG. 1, a guard bar 140 is connected to the collar assembly 28. The guard bar 140 comprises a horseshoe shaped rod 142 with a first end 144 attached to the first flange portion 126 and a second end 146 attached to the second flange portion 128. In the embodiment shown in the figures, each of the flange portions 126, 128 includes a circular recess 148 which accepts the ends 144, 146 of the guard bar 140, and the guard bar 140 is securely attached by bolts 150.

To connect the fuel nozzle 20 to the fueling adapter 40 of the aircraft, the operator aligns the three locating pins 100 with the three indexing notches 44 of the fueling adapter 40. The lock tabs 46 of the fueling adapter 40 also align with the corresponding gaps 138 formed in the bayonet ring 122. When properly aligned, the nozzle body 20 can be pushed onto the fueling adapter 40, thereby depressing the interlock plate 114. The depression of the interlock plate 114 clears the physical interference with the bayonet ring 122 within the collar assembly 28. The collar assembly 28 can be rotated clockwise with respect to the fueling adapter 40, perfecting a bayonet style connection between the collar assembly 28 and fueling adapter 40.

In addition, the rotation of the collar assembly 28 releases the mechanical interlock operative upon the valve operating handle 72. The release of this mechanical interlock allows counter-clockwise rotation of the valve operating handle 72 which in turn utilizes linkage to drive the valve stem 36 downwardly such that the poppet valve 32 is pushed away from the nose seal 98 to allow fuel to flow through the fuel nozzle 20 and into the aircraft. Once fueling is complete, the operator rotates the valve operating handle 72 to the clockwise position shown in FIG. 1 which in turn draws the poppet valve 32 against the nose seal 98 and completing the closure of the fuel nozzle 20 and precluding further fuel flow. With the valve operating handle 72 returned to the closed position, the collar assembly 28 is rotated with respect to the nozzle body 22 to release engagement of the fuel nozzle 20.

Although the present invention has been described in detail with regarding the exemplary embodiments and drawings thereof, it should be apparent to those skilled in the art that various adaptations may be accomplished without departing from the spirit and scope of the invention. Accordingly, the invention is not limited to the precise embodiment shown in the drawings and described in detail hereinabove.

What is claimed is:

1. A fuel servicing nozzle for mating with an aircraft fueling adapter having a cylindrical extension with a plurality of indexing notches and a plurality of radially extending lock tabs, comprising:

a nozzle body having an outer surface, an interior passage, and a base, said base having a plurality of bores;

a plurality of locating pins received within said plurality of bores and extending beyond said base, said locating pins having a square-shaped cross-section, each said plurality of locating pins shaped to fit into each corresponding said indexing notches;

wherein each said plurality of locating pins has a generally cylindrical portion received within each said plurality of bores, said square-shaped cross-section extending beyond said surface;

a collar assembly rotatable supported upon said outer surface of said nozzle body; and an interlock plate biased toward an exterior of said nozzle body at the aircraft connection end by a plurality of spaced springs;

wherein said interlock plate includes a plurality of apertures through which said locating pins pass, when said fuel nozzle is in a disconnected condition with said fueling adapter, said interlock plate forming a mechanical interference between said plurality of locating pins and inner surfaces of a bayonet ring within said collar assembly such that said collar assembly is locked about said nozzle body, and when said fuel nozzle is connected to said fueling adapter, said interlock plate is depressed and said mechanical interference is cleared such that said collar assembly is free to rotate about said nozzle body.

2. The fuel servicing nozzle of claim 1, further comprising lugs disposed on said inner surfaces of said bayonet ring, wherein said interlock plate forms said mechanical interference with said lugs when said fuel nozzle is in a disconnected condition with said fueling adapter, and wherein said interlock plate is depressed and said mechanical interference with said lugs is cleared such that said collar assembly is free to rotate about said nozzle body.

3. The fuel servicing nozzle of claim 1, further comprising:

an operating handle rotatively coupled to said nozzle body; and a guard bar connected to said collar assembly such that said guard bar protects said operating handle when said fuel servicing nozzle is dropped or dragged on the ground.

4. The fuel servicing nozzle of claim 3, wherein said collar assembly includes a main portion being generally cylindrical-shaped and surrounding said nozzle body, a first flange portion extending radially outwardly from said main portion, and a second flange portion extending radially outwardly from said main portion and offset 180 degrees from said first flange portion.

5. The fuel servicing nozzle of claim 4, wherein said guard bar is a horseshoe shaped rod with a first end attached to said first flange portion and a second end attached to said second flange portion.

6. The fuel servicing nozzle of claim 1, wherein said cylindrical portion is threaded into said bore.

7. The fuel servicing nozzle of claim 1, wherein each of said plurality of indexing notches has a first flat side and a second flat side and each of said plurality of locating pins have a first flat side and a second flat side, wherein said first flat side of said locating pin directly contacts said first flat side of said indexing notch, and said second flat side of said locating pin directly contacts said second flat side of said indexing notch.

8. The fuel servicing nozzle of claim 1, wherein said plurality of locating pins are formed from stainless steel.

9. The fuel servicing nozzle of claim 1, wherein said bayonet ring includes a plurality of gaps, said bayonet ring for engaging said lock tabs of said fueling adapter.

10. The fuel servicing nozzle of claim 9, wherein said bayonet ring is embedded in said collar assembly during the casting of said collar assembly.

11. The fuel servicing nozzle of claim 1, further comprising:

a web having a generally flat wall extending radially outwardly with sides contacting a side wall of said interior passage;

a crank shaft extending transversely across the entire inner diameter of said interior passage; and a cradle formed on top of said web and being supported by said web, said cradle supporting said crank shaft.

12. The fuel servicing nozzle of claim 11, wherein said cradle includes a top portion shaped to conform to the diameter of said crank shaft, and a center portion being interrupted to allow for rotation of a crank arm of said crank shaft.

13. The fuel servicing nozzle of claim 12, wherein said top portion of said cradle has a concave-shaped top surface.

14. The fuel servicing nozzle of claim 11, wherein the longitudinal axis of said cradle and said crank shaft lie along a plane of said web to maximize the flow rate of fuel of said nozzle body.

15. The fuel servicing nozzle of claim 11, further comprising:

a poppet valve located at an exit end of said nozzle body, said poppet valve sealing fuel flow when closed and allowing fuel flow when opened;

a valve stem connected to said poppet valve at a first end and connected to said crankshaft at a second end such that said valve stem being actuated by said crank shaft to push said poppet valve into said fueling adapter, thereby opening a delivery flow path; and a sleeve disposed on a lower portion of said web, said sleeve guiding said valve stem.

16. The fuel servicing nozzle of claim 11, wherein said nozzle body, said cradle, said sleeve and said web are an integral unit.

17. The fuel servicing nozzle of claim 16, wherein said nozzle body, said cradle, said sleeve and said web are an investment casting.

18. The fuel servicing nozzle of claim 11, wherein said interior passage is split into two generally equally sized and shaped passageways by said web.

19. The fuel servicing nozzle of claim 1, wherein said collar assembly is an integral investment casting made from a first metallic material, and wherein said bayonet ring is embedded in said collar assembly and made from a second metallic material, said second metallic material being harder and denser than said first metallic material.

20. A fuel servicing nozzle for mating with an aircraft fueling adapter having a cylindrical extension with a plurality of indexing notches and a plurality of radially extending lock tabs, comprising:

a nozzle body having an outer surface, an interior passage, and a base, said base having a plurality of bores;

a plurality of locating pins received within said plurality of bores and extending beyond said base, said locating pins having a square-shaped cross-section, each said plurality of locating pins shaped to fit into each corresponding said indexing notches;

wherein each said plurality of locating pins has a generally cylindrical portion received within each said plurality of bores, said square-shaped cross-section extending beyond said surface;

a collar assembly rotatably supported upon said outer surface of said nozzle body; and an interlock plate biased toward an exterior of said nozzle body at the aircraft connection end by a plurality of spaced springs;

wherein said interlock plate includes a plurality of square-shaped apertures through which said locating pins pass, said apertures having sides located in close proximity to sides of said locating pins to prevent rotation of said locating pins.

21. The fuel servicing nozzle of claim 20, further comprising:

an operating handle rotatively coupled to said nozzle body; and a guard bar connected to said collar assembly such that said guard bar protects said operating handle when said fuel servicing nozzle is dropped or dragged on the ground.

22. The fuel servicing nozzle of claim 21, wherein said collar assembly includes a main portion being generally cylindrical-shaped and surrounding said nozzle body, a first flange portion extending radially outwardly from said main portion, and a second flange portion extending radially outwardly from said main portion and offset 180 degrees from said first flange portion.

23. The fuel servicing nozzle of claim 22, wherein said guard bar is a horseshoe shaped rod with a first end attached to said first flange portion and a second end attached to said second flange portion.

24. The fuel servicing nozzle of claim 20, wherein said cylindrical portion is threaded into said bore.

25. The fuel servicing nozzle of claim 20, wherein each of said plurality of indexing notches has a first flat side and a second flat side and each of said plurality of locating pins have a first flat side and a second flat side, wherein said first flat side of said locating pin directly contacts said first flat side of said indexing notch, and said second flat side of said locating pin directly contacts said second flat side of said indexing notch.

26. The fuel servicing nozzle of claim 20, wherein said plurality of locating pins are formed from stainless steel.

27. The fuel servicing nozzle of claim 20, further comprising:

a bayonet ring disposed on said collar assembly;

when said fuel servicing nozzle is in a disconnected condition with said fueling adapter, said interlock plate forms a mechanical interference with an inner surface of said bayonet ring such that said collar assembly is locked about said nozzle body; and when said fuel nozzle is connected to said fueling adapter, said interlock plate is depressed and said mechanical interference is cleared such that said collar assembly is free to rotate about said nozzle body.

28. The fuel servicing nozzle of claim 27, further comprising lugs extending outwardly from an inner surface of said bayonet ring, wherein said interlock plates forms said mechanical interference with said lugs.

29. The fuel servicing nozzle of claim 27, wherein said bayonet ring is embedded in said collar assembly during the casting of said collar assembly.

30. The fuel servicing nozzle of claim 20, further comprising:

a web having a generally flat wall extending radially outwardly with sides contacting a side wall of said interior passage;

a crank shaft extending transversely across the entire inner diameter of said interior passage; and a cradle formed on top of said web and being supported by said web, said cradle supporting said crank shaft.

31. The fuel servicing nozzle of claim 30, wherein said cradle includes a top portion shaped to conform to the diameter of said crank shaft, and a center portion being interrupted to allow for rotation of a crank arm of said crank shaft.

32. The fuel servicing nozzle of claim 31, wherein said top portion of said cradle has a concave-shaped top surface.

33. The fuel servicing nozzle of claim 30, wherein the longitudinal axis of said cradle and said crank shaft lie along a plane of said web to maximize the flow rate of fuel of said nozzle body.

34. The fuel servicing nozzle of claim 30, further comprising:

a poppet valve located at an exit end of said nozzle body, said poppet valve sealing fuel flow when closed and allowing fuel flow when opened;

a valve stem connected to said poppet valve at a first end and connected to said crankshaft at a second end such that said valve stem being actuated by said crank shaft to push said poppet valve into said fueling adapter, thereby opening a delivery flow path; and a sleeve disposed on a lower portion of said web, said sleeve guiding said valve stem.

35. The fuel servicing nozzle of claim 34, wherein said nozzle body, said cradle, said sleeve and said web are an integral unit.

36. The fuel servicing nozzle of claim 35, wherein said nozzle body, said cradle, said sleeve and said web are an investment casting.

37. The fuel servicing nozzle of claim 30, wherein said interior passage is split into two generally equally sized and shaped passageways by said web.

38. The fuel servicing nozzle of claim 20, wherein said collar assembly is an integral investment casting made from a first metallic material, and wherein said bayonet ring is embedded in said collar assembly and made from a second metallic material, said second metallic material being harder and denser than said first metallic material.

39. A method for forming a fuel servicing nozzle for mating with an aircraft fueling adapter having a cylindrical extension with a plurality of indexing notches and a plurality of radially extending lock tabs, comprising the steps of:

(a) providing a nozzle body having an outer surface, an interior passage, and a base;

(b) providing a plurality of locating pins on the base, the locating pins having a square-shaped cross-section and shaped to fit into the corresponding indexing notches;

(c) rotatable mounting a collar assembly on the outer surface of the nozzle body;

(d) providing an interlock plate which is biased toward an exterior of the nozzle body at an aircraft connection end by a plurality of spaced springs; and (e) providing the interlock plate with a plurality of square-shaped apertures through which the locating pins pass, when the fuel nozzle is in a disconnected condition with the fueling adapter, the interlock plate forms a mechanical interference between the plurality of locating pins and inner surfaces of a bayonet ring such that the collar assembly is locked about the nozzle body, and when the fuel nozzle is connected to the fueling adapter, the interlock plate is depressed and the mechanical interference is cleared such that the collar assembly is free to rotate about the nozzle body.

40. The method of claim 39, wherein the square-shaped apertures have sides located in close proximity to sides of the locating pins to prevent rotation of the locating pins.

41. The method of claim 39, wherein each of the indexing notches has a first flat side and a second flat side and each locating pin has a first flat side and a second flat side, wherein the first flat side of the locating pin directly contacts the first flat side of the indexing notch and the second flat side of the locating pin directly contacts the second flat side of the indexing notch.

42. The method of claim 39, further comprising the step of providing outwardly extending lugs on the inner surfaces of the bayonet ring, wherein the interlock plate forms the mechanical interference with the lugs when the fuel servicing nozzle is in a disconnected condition with the fueling adapter, and wherein the interlock plate is depressed and the mechanical interference with the lugs is cleared such that the collar assembly is free to rotate about the nozzle body.

43. The method of claim 39, further comprising the steps of:

(a) extending a web radially outwardly, wherein the web being a generally flat wall with sides contacting a side wall of the interior passage;

(c) extending a crank shaft transversely across the entire inner diameter of the interior passage; and (d) forming a cradle on top of the web, wherein the cradle supports the crank shaft.

44. The method of claim 43, wherein a top portion of the cradle is concave-shaped to conform to the diameter of the crank shaft, and a center portion being interrupted to allow for rotation of a crank arm of the crank shaft.

45. The method of claim 43, wherein the passage is split into two generally equally sized and shaped passageways by the web.

* * * * *

UNITED STATES PATENT AND TRADEMARK OFFICE

CERTIFICATE OF CORRECTION

PATENT NO. : 6,142,194
DATED : November 7, 2000
INVENTOR(S) : Mark Randall McClaran It is certified that error appears in the above-identified patent and that said Letters Patent is hereby corrected as shown below:

The sheets of drawings, consisting of figures 7-10 should be deleted to appear as per attached figures 7-10.

Signed and Sealed this

Twelfth Day of March, 2002

*Attest:*

*Attesting Officer*

JAMES E. ROGAN
*Director of the United States Patent and Trademark Office*

FIG. 9
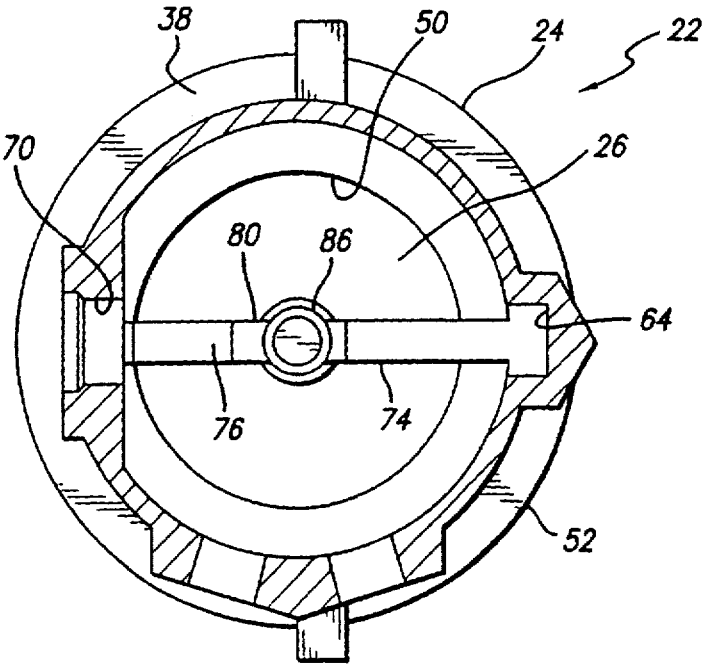
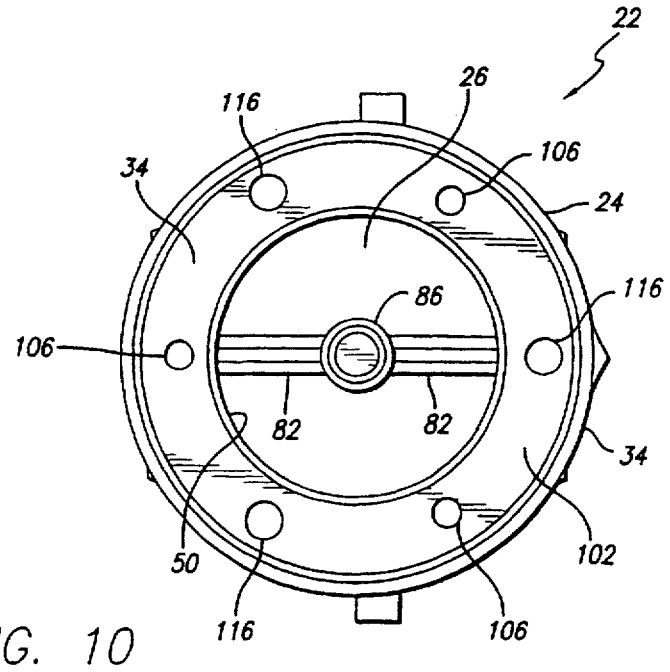
FIG. 10